US006438829B1

(12) United States Patent
Haake

(10) Patent No.: US 6,438,829 B1
(45) Date of Patent: Aug. 27, 2002

(54) METHODS FOR FABRICATING AND USING A PLURALITY OF ELECTRICAL CONTACT DEVICES

(75) Inventor: John Martin Haake, St. Charles, MO (US)

(73) Assignee: McDonnell Douglas Corporation, St. Louis, MO (US)

( * ) Notice: Subject to any disclaimer, the term of this patent is extended or adjusted under 35 U.S.C. 154(b) by 0 days.

(21) Appl. No.: 09/459,666

(22) Filed: Dec. 13, 1999

Related U.S. Application Data

(62) Division of application No. 08/923,572, filed on Sep. 4, 1997, now Pat. No. 6,000,977.

(51) Int. Cl.[7] ..... H01R 43/16

(52) U.S. Cl. ..... 29/874; 29/876; 29/881; 29/884; 174/261; 174/262; 439/289

(58) Field of Search ..... 29/874, 876, 881, 29/884; 174/261, 262; 439/289

(56) References Cited

U.S. PATENT DOCUMENTS 3,604,110 A * 9/1971 Jerolamon ..... 29/626
4,420,877 A * 12/1983 McKenzie ..... 29/739
5,376,226 A * 12/1994 Lau ..... 156/643
5,409,386 A 4/1995 Banakis et al.
5,433,631 A * 7/1995 Beaman ..... 439/493
5,451,169 A * 9/1995 Corbell, III ..... 439/289
5,576,675 A * 11/1996 Oldfield ..... 333/260
5,816,868 A 10/1998 Legrady et al.
5,850,693 A * 12/1998 Guran ..... 29/884
5,875,546 A 3/1999 Cachina et al.

* cited by examiner

*Primary Examiner*—Peter Vo
*Assistant Examiner*—Paul Kim
(74) *Attorney, Agent, or Firm*—Alston & Bird LLP

(57) ABSTRACT

Each of a pair of composite structures includes at least one tubular member that is at least partially conductive and defines an electrical port. Each tubular member is electrically connected at a first end to a respective electrical lead and has a second end opening through an edge surface of the composite structure. A method for establishing electrical contact between the electrical leads includes electrically engaging the tubular member that defines the electrical port of each composite structure with a respective electrical contact device. The electrical contact device comprises an electrical contact pad and a conductive pin connected to and extending outwardly from the electrical contact pad such that engaging the tubular member includes inserting the conductive pin into the tubular member. Then, corresponding electrical contact pads are at least partially aligned to thereby establish electrical contact between corresponding electrical leads embedded within the pair of composite structures.

3 Claims, 4 Drawing Sheets

40
40
44
46
48
42
42'
44'
46'
48'

METHODS FOR FABRICATING AND USING A PLURALITY OF ELECTRICAL CONTACT DEVICES

RELATED APPLICATIONS

This application is a divisional of U.S. patent application Ser. No. 08/923,572, filed Sep. 4,1997 and now U.S. Pat. No. 6,000,977.

Government License Rights

The United States Government has rights in this invention as provided for by the terms of Contract Number NAS1-19244 awarded by the National Aeronautics and Space Administration.

FIELD OF THE INVENTION

The present invention relates generally to electrical contact devices and associated fabrication methods and, more particularly, to electrical contact devices for making electrical contact between electrical leads embedded within composite structures and related fabrication methods.

BACKGROUND OF THE INVENTION

Composite structures are employed in an increasing number of applications, such as a variety of automotive and aviation applications. Regardless of the particular application, composite components can be formed by laying up or stacking a number of plies, such as on a tool or mandrel which, at least partially, defines the shape of the resulting composite structure. The plies are thereafter consolidated, such as by an autoclave process, into an integral laminate structure.

In addition to conventional autoclave processes, composite components can be fabricated by a fiber placement process in which plies of fibrous tow pre-impregnated with thermoset or thermoplastic resin, typically termed prepregs, are individually placed on and consolidated to an underlying composite structure. Preferably, a laser heats the lower surface of the fiber-placed ply and the upper surface of the underlying composite structure to at least partially melt a localized region of the ply. Compactive pressure is then applied to the at least partially molten region of the ply, such as by a roller disposed downstream of the laser, so as to consolidate the fiber-placed ply and the underlying composite structure, thereby forming the integral laminate structure. One advantage of a fiber placement process is that the composite material can-be cured on the fly, thereby reducing the time required to fabricate a composite part.

Another method of fabricating composite components is a resin transfer molding (RTM) process. According to a RTM process, a number of fibers, such as graphite or glass fibers, are woven to form a woven fiber intermediate structure. For example, the fibers can be woven on a loom-type structure as known to those skilled in the art. Resin can then be introduced to the woven fiber intermediate structure such that, once the resin has cured, the resulting composite component formed from the resin-impregnated woven fiber structure is created.

An emerging area of interest with respect to composite structures involves the design and development of smart structures. Smart structures generally refer to composite structures which include one or more interactive electronic devices. For example, monolithic or multi-layer electroceramic actuators can be embedded within a composite structure so as to induce vibrations within the composite structure. In particular, an electroceramic actuator can induce vibrations in the composite structure in order to offset or damp externally induced vibrations of the composite structure. In addition, smart structures can include other electrical devices, such as antennas and integrated circuits.

Even if the electrical device withstands the fabrication process, including the relatively high temperatures and relatively high pressures to which the device is exposed during consolidation, the electrical device must still be able to receive, and in many instances, transmit signals in order to function as desired. Accordingly, the embedded electrical device, such as an electroceramic actuator, typically includes a pair of electrical leads which are routed to the surface or edge of the resulting composite structure in order to provide for an external electrical connection, such as with an electrical lead extending outwardly from another composite structure.

A composite structure generally includes inner and outer surfaces through which the electrical leads of the embedded electrical device extend. In order to facilitate connection with other electrical devices, the electrical leads are typically routed through the inner surface of the resulting composite structure. Accordingly, troughs or bores must be formed or cut in the composite structure, such as from the interior surface thereof, so that the electrical leads can extend therethrough.

However, the surface egress of the electrical leads of an embedded electrical device is primarily effective in instances in which a hollow composite structure is fabricated, such as a trapezoidal rail, which permits the electrical leads to be routed to the hollow interior of the composite structure. In contrast, in instances in which the composite structure is not hollow, such as a solid or a relatively planar composite structure, the surface egress of the electrical leads of the embedded electrical device is less effective since the electrical leads will protrude from a surface, such as the exterior surface, of the composite structure and may interfere with the performance of the structure. In addition, electrical leads which protrude through the edge surface of one composite structure may obstruct or otherwise interfere with the alignment and interconnection of adjacent composite structures since adjacent composite structures must generally be brought into contact along the edge surfaces thereof.

Thus, the electrical leads typically extend into and are disposed within the hollow mandrel in a random order. Consequently, the electrical leads can become entangled with other electrical leads or with other surface-egressed components, such as optical fibers, to form a tangled web which is relatively difficult to disentangle. In addition, the electrical leads which extend into the hollow mandrel can sever other surface-egressed components, such as optical fibers, and can render repair of the components difficult, thereby impairing the performance of the resulting composite structure.

As a result of manufacturing or other limitations, a number of composite structures must oftentimes be mechanically joined in order to form even larger composite structures. As described above, electrical leads typically extend through many of the composite structures in order to interconnect actuators and other electrical components embedded within the composite structures. In addition to mechanically joining the composite structures, the electrical leads extending from a respective composite structure must therefore be connected to corresponding electrical leads extending from another composite structure.

In order to make the necessary electrical connections, the electrical leads of a conventional smart structure must first be disentangled. As will be apparent, the disentanglement of the electrical leads is a time consuming and tedious process. Once disentangled and connected, care must be taken to insure that the interconnected electrical leads are insulated from the composite structure which is itself at least partially electrically conductive. In addition, the interconnected electrical leads must be stored or located in a manner which does not impede the mechanical connection of the composite structures or the performance of the resulting structure. Therefore, even though the electrical leads extending from a number of individual composite structures can be interconnected, conventional techniques suffer from a number of deficiencies, including the time consuming and tedious nature of the interconnections, as described above.

As described in copending U.S. patent application Ser. No. 08/473,098 (the '098 application) filed Jun. 7, 1995, the contents of which are expressly incorporated in their entirety herein, a composite structure having one or more embedded electrical components is described. The composite structure of the '098 application includes a number of conductive tubes embedded within the composite structure that are connected to a respective electrical lead at one end and that open through an edge surface at the other end. Accordingly, electrical contact can be established with an electrical lead and, in turn, with the embedded electrical component from which the electrical lead extends by plugging a pin-like connector into a respective tube. Although the composite structure described by the '098 application is a great advance in the art, precise alignment is required in order to interconnect the electrical leads embedded within a pair of adjacent composite structures since the same pin-like connector must be inserted into a respective tube from each composite structure.

SUMMARY OF THE INVENTION

It is therefore an object of the present invention to provide an electrical contact device for establishing electrical contact with an electrical lead embedded within a composite structure without requiring the electrical lead to extend through the surface or edge of the composite structure, thereby eliminating tangled electrical wires and the resulting time and difficulty associated with disentangling the electrical leads prior to establishing electrical connection.

It is another object of the present invention to provide for simultaneous electrical contact to be established between the electrical leads embedded with a pair of composite structures upon joining the composite structures.

These and other objects are provided, according to the present invention, by an electrical contact device for establishing electrical contact with a tubular electrical port opening through an edge surface of a composite structure. The electrical contact device includes a contact pad having opposed inner and outer surfaces. The outer surface is formed of an electrically conductive material, while the inner surface is formed of an insulating material, such as an epoxy. The electrical contact device also includes an electrically conductive pin attached to and extending outwardly from the electrical contact pad such that the pin is in electrical contact with the outer surface of the pad. Upon insertion within a tubular electrical port that opens through the edge surface of a composite structure, the pin serves to establish electrical contact between the tubular electrical port and the conductive outer surface of the contact pad, while the insulative inner surface serves to insulate the electrical contact device from the composite structure.

In order to improve the electrical performance of the electrical contact pad, the electrical contact pad of one advantageous embodiment includes a metallic substrate having inner and outer surfaces and a coating on the outer surface that has a greater electrical conductivity than the metallic substrate. For example, the metallic substrate can be formed of stainless steel and the coating can be formed of copper, nickel, gold or alloys thereof. The electrical contact device can also include an extension arm formed of a conductive material and extending outwardly from the outer surface of the electrical contact pad in order to further improve its electrical contact with another electrical contact device.

The pin is also generally formed of the same material as the metallic substrate, such as stainless steel. The pin is also preferably sized to have a diameter that is no larger than the inner diameter of the respective tubular electrical port. Typically, the pin has a diameter that is within 10% of the inner diameter of the respective tubular electrical port.

Typically, the composite structure is a multi-ply laminate structure having an edge surface and an electrical lead extending at least partially through the laminate structure. This composite structure also includes at least one embedded tube. A first end of the tube electrically contacts the electrical lead, while the second end of the tube opens through the edge surface to define an electrical port. By inserting the pin into the electrical port, electrical contact is established with the electrical lead.

By employing the electrical contact devices of the present invention, a pair of composite structures can be joined in such a manner that electrical leads embedded within the respective composite structures can be readily interconnected. In this regard, the pins of a number of electrical contact devices are initially inserted into respective tubular electrical ports of the pair of composite structures. By subsequently aligning the edge surfaces of the pair of respective composite structures, corresponding contact pads of each respective composite structure are also aligned and brought into contact, thereby establishing electrical contact between corresponding electrical leads embedded within the pair of composite structures. Consequently, simultaneous electrical and mechanical contact can be established between the electrical contact devices extending from the edge surface of one of the composite structures and corresponding ones of the electrical contact devices extending from the edge surface of the other composite structure.

The present invention also provides a method of fabricating a plurality of electrical contact devices. This advantageous method initially attaches a plurality of conductive pins to a strip of conductive material such that the pins are spaced along the conductive strip. According to one embodiment, holes are formed at a number of locations spaced along the strip. Conductive pins are then inserted through respective holes and bonded to the conductive strip. The strip of conductive material is then divided between each of the conductive pins to create a plurality of electrical contact devices.

The strip of conductive material preferably includes an outer surface and an opposed inner surface from which the pins extend. In order to isolate the conductive strip from the edge surface of a composite structure, an insulating material is typically applied to the inner surface of the conductive strip. In addition, the outer surface of the conductive strip can be coated with a conductive material having a greater electrical conductivity than the strip.

As a result of the construction of the electrical contact devices of the present invention, electrical contact can be readily established between corresponding electrical leads embedded within a pair of composite structures. Once inserted into a respective port, the pin makes electrical contact with one of the embedded electrical leads, while the remainder of the electrical contact device is electrically isolated from the edge surface of the composite structure. By appropriately aligning the edge surfaces of a pair of composite structures, electrical and mechanical contact can be simultaneously established between one or more pairs of electrical contact devices, thereby making electrical contact between corresponding electrical leads embedded within the composite structures without requiring the electrical leads to extend outwardly from the composite structure and to be individually interconnected.

DETAILED DESCRIPTION OF THE PREFERRED EMBODIMENT

The present invention will now be described more fully hereinafter with reference to the accompanying drawings, in which a preferred embodiment of the invention is shown. This invention may, however, be embodied in many different forms and should not be construed as limited to the embodiment set forth herein; rather, this embodiment is provided so that this disclosure will be thorough and complete and will fully convey the scope of the invention to those skilled in the art. Like numbers refer to like elements throughout.

Figure 1:
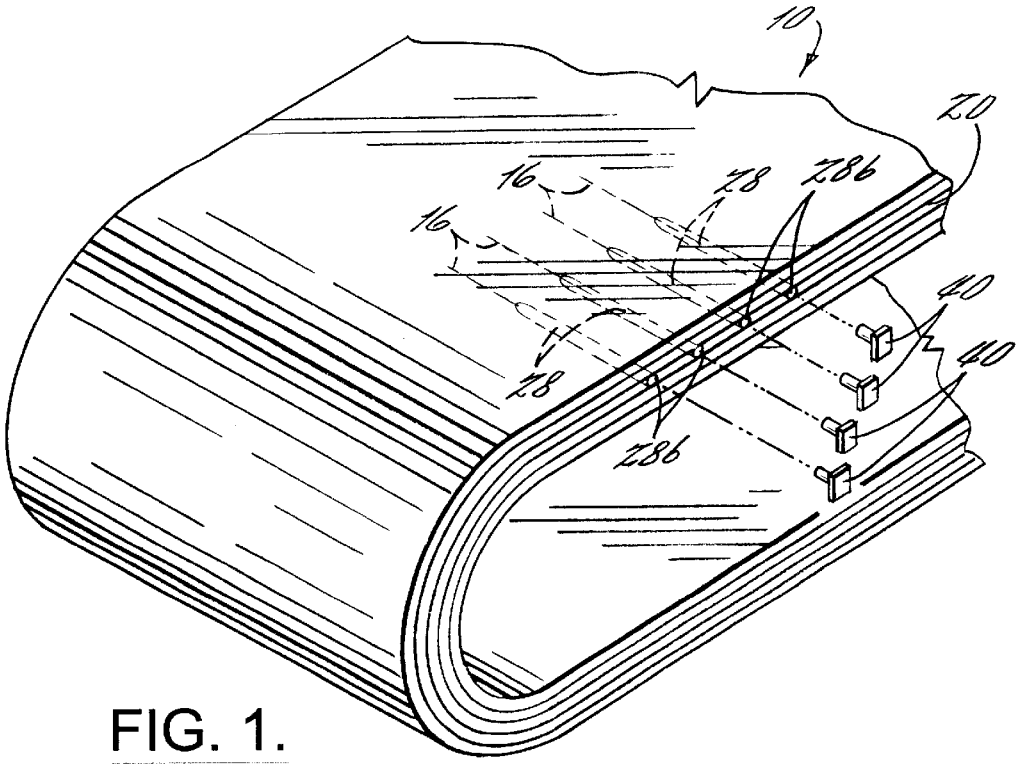
FIG. 1 is a perspective view of a composite structure illustrating the electrical ports that open through the edge surface of the composite structure and the electrical contact devices that are adapted to be inserted into the ports.

Referring now to FIG. 1, electrical contact devices 40 according to the present invention are illustrated prior to insertion into respective tubular ports 28 that open through the edge surface 20 of a composite structure 10. For example, the composite structure can be an automotive component or an aircraft component, such as a rudder, fairing or aileron. As shown, the composite structure is generally comprised of a plurality of plies 12 which are stacked and consolidated to thereby form a multi-ply laminate structure. The plies can be laid up and consolidated in any manner known to those skilled in the art, such as by a conventional autoclave curing process or by a fiber placement process. Alternatively, the composite structure can be formed by resin transfer molding (RTM).

The plurality of plies 12 or the woven fiber intermediate structure can be formed of any of a variety of composite materials known to those skilled in the art. For example, even though the plies are typically formed of carbon fiber-reinforced composite materials, the composite structure 10 can be comprised of nonconductive or insulating plies, such as fiberglass plies, without departing from the spirit and scope of the present invention.

Figure 3:
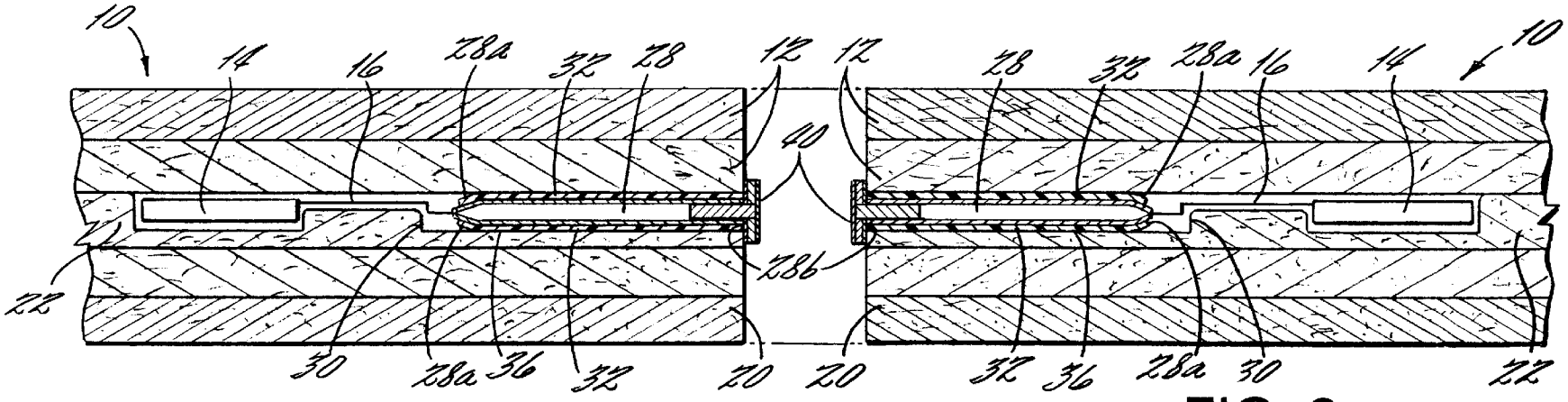
FIG. 3 is a cross-sectional view of the pair of composite structures of the embodiment illustrated in FIG. 2 taken along line 3—3 that illustrates the embedded electrical devices, the embedded connector tows including the tubular electrical ports, and the electrical contact devices inserted into the tubular electrical ports.

As illustrated in cross-section in FIG. 3, an electrical device 14 is preferably disposed within the composite structure 10, such as the illustrated multi-ply laminate structure or a woven fiber intermediate structure. The electrical device can include, for example, a monolithic or multi-layer electroceramic actuator, which can induce vibrations within the composite structure. However, the composite structure can include a variety of other types of electrical devices without departing from the spirit and scope of the present invention. For example, the electrical device can include an antenna or an integrated circuit which is embedded within the composite structure.

Regardless of the type of electrical device 14, the electrical device includes at least one electrical lead 16 and, in most instances, two or more electrical leads for transmitting signals to and receiving signals from an external source, such as an external controller or a central computer. Consequently, the external source can monitor or actively control the embedded electrical device of the smart composite structure 10.

According to the present invention, one or more tubes 28 are embedded within the composite structure 10. As described in more detail in co-pending U.S. patent application Ser. No. 08/473,098, each tube 28 is electrically insulated from the composite structure, and extends longitudinally from a first end 28*a* to an opposed second end 28*b* so as to define a lengthwise extending bore therethrough. For example, the tube can be a hypodermic tube comprised of a conductive material, such as stainless steel. Preferably, the tubes are both electrically and thermally conductive such that the tubes can effectively remove heat from the embedded electrical device. In one embodiment, the tubes have an outer diameter of 0.020 inches and an inner diameter of 0.010 inches. However, the tubes can have a variety of dimensions and be comprised of a variety of materials without departing from the spirit and scope of the present invention. In addition, while the tube is illustratively shown as being circular in lateral cross-section, the tube can be formed in a variety of cross-sectional shapes, such as rectangular, elliptical or square, without departing from the spirit and scope of the present invention.

The composite structure 10 preferably includes at least as many tubes 28 as the embedded electrical devices 14 have electrical leads 16. In addition, the tubes are preferably disposed between first and second film layers 32. See FIG. 3. In particular, the first and second film layers are typically adhered to opposite sides of the tubes, such as the top and bottom sides as illustrated, between the respective first and second ends 28*a* and 28*b* of the tubes. Thus, the relative positions of the tubes are fixed with respect to the first and second film layers. A variety of adhesives can be employed to bond the first and second film layers to the plurality of tubes without departing from the spirit and scope of the present invention, and in one embodiment, the adhesive has a thickness of 0.025 inches to 0.030 inches. However, the adhesive also can have various thicknesses without departing from the spirit and scope of the present invention.

Since the composite structure 10 is oftentimes formed of conductive fibers, the conductive tubes 28 are preferably electrically isolated from the conductive composite structure. In this regard, the first and second film layers 32 are preferably comprised of an insulating material, such as polyetheretherketone (PEEK) or polyetherimide, such that the plurality of conductive tubes 28 disposed therebetween are electrically isolated from the conductive composite structure.

In addition, in embodiments of the present invention in which an end portion of a tube 28 extends beyond the first and second insulating film layers 32, the portion of the tube which extends beyond the film layers is also preferably electrically isolated from the conductive composite structure 10, such as by wrapping the portion of the tube which extends beyond the film layers with a sheet of insulating material, such as polyamide. Accordingly, the conductive tubes can be electrically isolated from the conductive composite structure.

The electrical leads 16 also generally include a conductor coated with an insulating jacket, such a jacket comprised of a KAPTON™ material, to provide electrical isolation from the conductive composite structure 10. As described below, electrical contact can therefore be established via the externally accessible electrical ports defined by the respective second ends 28*b* of the tubes 28 which open through the edge surface 20 of the laminate structure without electrically contacting the conductive composite structure.

As shown in cross-section in FIG. 3, the first end 28*a* of each tube 28 is preferably electrically connected to a respective electrical lead 16 of the electrical device 14. For example, the first end of each conductive tube can be crimped about the respective electrical lead to physically secure and establish electrical contact with the electrical lead.

As also illustrated in FIG. 3, the respective second end 28*b* of each of the tubes 28 preferably extends at least to the peripheral edge of the supporting ply 12. However, even if the respective second ends of the plurality of tubes are embedded within the plies of composite material during the fabrication of the composite structure 10, the respective second ends of the tubes can be subsequently accessed by machining or otherwise removing the edge without departing from the spirit and scope of the present invention.

In this regard, if the respective second ends 28*b* of the tubes 28 are embedded within the composite structure 10 during the fabrication of its composite structure, the respective second ends of the tubes are preferably accessed following the consolidation of the stacked plies 12 into an integral laminate structure. In particular, the edge surface 20 of the resulting laminate structure can be machined, such as by sawing, to thereby expose the respective second ends of the tubes. In one embodiment, a water cooled diamond-tipped saw can be employed to cut or remove a portion of the edge surface of the laminate structure, thereby exposing the second end of each tube. Thereafter, corresponding electrical contact devices 40 can be inserted in the respective ports defined by the open second ends of the tubes in order to establish electrical contact with the embedded electrical leads 16, as described hereinbelow.

As best illustrated in FIG. 1, the integral laminate structure has opposed inner and outer surfaces 12*a* and 12*b*, respectively, and an edge surface 20 extending between the inner and outer surfaces and along a peripheral edge of the laminate structure. As also shown in FIGS. 1 and 3, the respective second ends 28*b* of the tubes 28 open through the edge surface of the laminate structure to thereby define a number of externally accessible electrical ports. The electrical ports are adapted to receive corresponding electrical contact devices 40 as described hereinbelow such that electrical contact can be established with each electrical lead 16 of the electrical device 14 without requiring the electrical leads to extend outwardly from the composite structure 10. As such, the electrical leads do not become tangled and do not otherwise obstruct the alignment and mechanical interconnection of a pair of composite structures.

Figure 4:
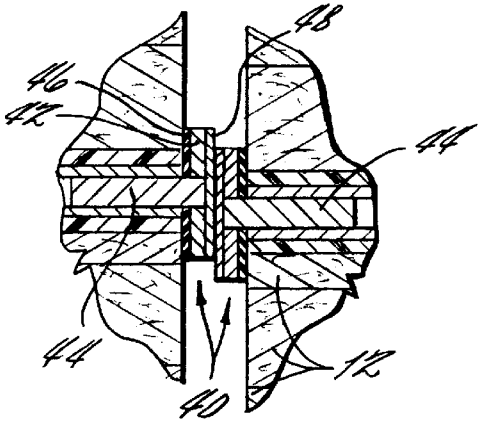
FIG. 4 is a partial cross-sectional view of a pair of adjacent composite structures illustrating the partial alignment and contact between the contact pads of the respective electrical contact devices.

According to the present invention, electrical contact devices 40 are inserted into the second ends of the conductive tubes 28*b*, thereby establishing electrical contact with the corresponding internal electrical leads 16. As illustrated in FIGS. 1, 3 and 4, the contact devices 40 are comprised of a contact pad 42 and a pin 44. The contact pad 42 includes a substrate having an inner surface 46 and an outer surface 48. Even though the substrate is generally formed from a conductive material, the outer surface of the contact pad is preferably plated or coated with a material having greater conductivity than that of the substrate so as to enhance the resulting electrical interconnection. Typically, the substrate is formed of a metal, such as stainless steel, and the more conductive outer coating is formed of copper, nickel, gold or alloys thereof. However, the substrate and the more conductive outer coating can be formed from a variety of other conductive materials without departing from the spirit and scope of the present invention. The inner surface 46 of the contact pad 42 is advantageously coated with an insulating material in order to electrically isolate the remainder of the electrical contact device 40 from the composite structure 10. In one advantageous embodiment, the insulating material is a thermoset epoxy, such as PEEK or polyetherimide, that both insulates the inner surface of the contact pad from the edge surface 20 of the composite structure 10 and attaches or adheres the electrical contact device to the composite structure. However, the inner surface of the contact pad can be coated with other types of insulating materials, including non-adhesive insulating materials without departing from the spirit and scope of the present invention.

The pin 44 is also formed of a conductive material and is attached to the contact pad 42 such that the pin and the contact pad are in electrical connection with one another. Although not required, the pin is typically formed of the same conductive material, such as stainless steel, as the substrate of the contact pad. The pin 44 is sized to be inserted into the second end 28*b* of the conductive tube 28 as illustrated by FIGS. 1–4. In this regard, the pin generally has the same general cross-sectional shape as the conductive tube, such as a circular cross-sectional shape, and is sized to have a predetermined diameter that is no larger than the predetermined diameter of the conductive tube. Preferably, the predetermined diameter of the pin is within 10% of the predetermined diameter of the conductive tube such that the pin fits snugly within the conductive tube, thereby establishing electrical contact with both the conductive tube and, in turn, with the electrical lead to which the tube is connected.

The electrical contact devices 40 of the present invention permit multiple composite structures 10 to be joined, typically in a side-by-side manner, with relative ease. As described above, the electrical contact devices are initially inserted into the second end 28*b* of the conductive tubes 28 and attached to the edge surface 20 of the composite structure. As shown in FIG. 3, the contact pad 42 of the electrical contact device is insulated from the composite structure by the insulative coating on the inner surface 46 of the contact pad. However, the pin 44 establishes electrical contact with the conductive tube that defines the respective electrical port. As such, electrical signals transmitted via the electrical lead 16 pass along the embedded conductive tube to the pin of the electrical contact device. Since the pin and the contact pad are electrically connected and since the outer surface 48 of the contact pad is plated with a highly conductive material, the electrical signal is then passed from the pin, to the contact pad, and finally to the highly conductive plating on the outer surface of the contact pad.

Figure 2:
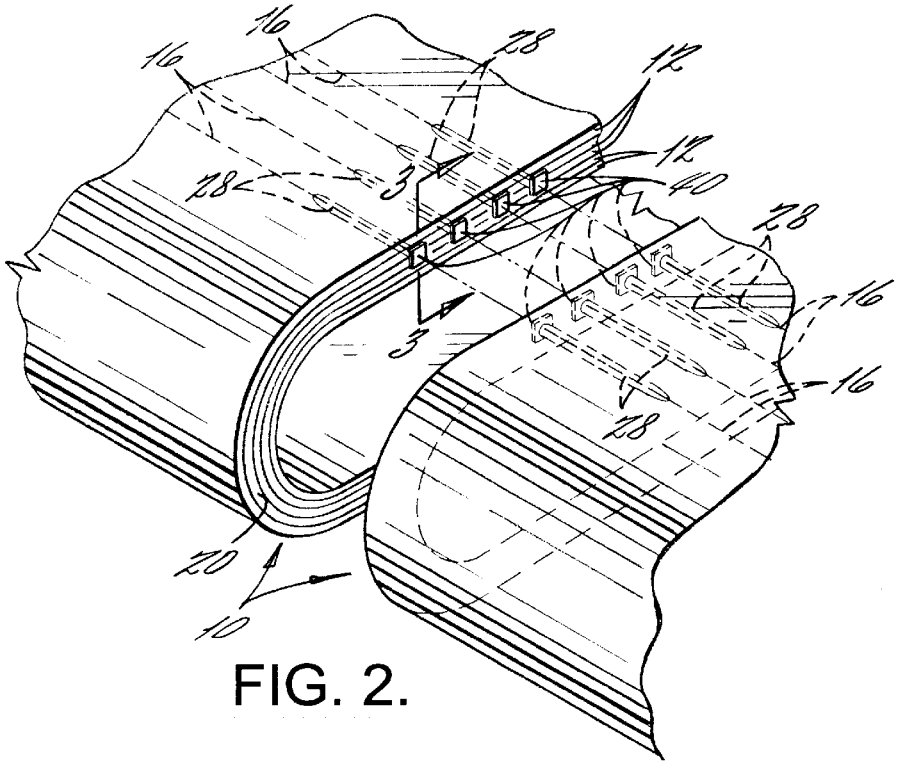
FIG. 2 is a perspective view of a pair of composite structures of the embodiment illustrated in FIG. 1 in an aligned position following insertion of the electrical contact devices into the appropriate ports.

Once the pins 44 of the electrical contact devices 40 have been inserted into the respective electrical ports, the edge surfaces 20 of a pair of composite structures 10 can be brought together in an abutting relationship as illustrated in FIG. 2. By positioning and spacing the electrical ports in the same manner within both composite structures, the edge surfaces of the composite structures can be aligned such that the electrical contact devices of one composite structure make electrical and mechanical contact with the electrical contact devices of the other composite structure. As such, corresponding electrical leads 16 embedded within the pair of composite structures can be interconnected. Once the electrical contact devices have been brought into contact, any remaining space between the edge surfaces of the adjacent composite structures can be filled, such as with an epoxy, such as a thermoset epoxy, or other adhesive.

As shown in FIG. 4, the contact pads 42 of a pair of electrical contact devices 40 need not be perfectly aligned in order to establish electrical connection therebetween. Instead, the composite structures 10 need only be aligned so that the corresponding contact pads make physical contact without also contacting an adjacent contact pad. As such, the fabrication of the composite structures is facilitated by this slight relaxation in the tolerances which govern the manufacturing process. In addition, although the contact pads of the illustrated embodiment are rectangular in shape, the contact pads can have other shapes, such as circular or elliptical, without departing from the spirit and scope of the present invention.

Figure 6:
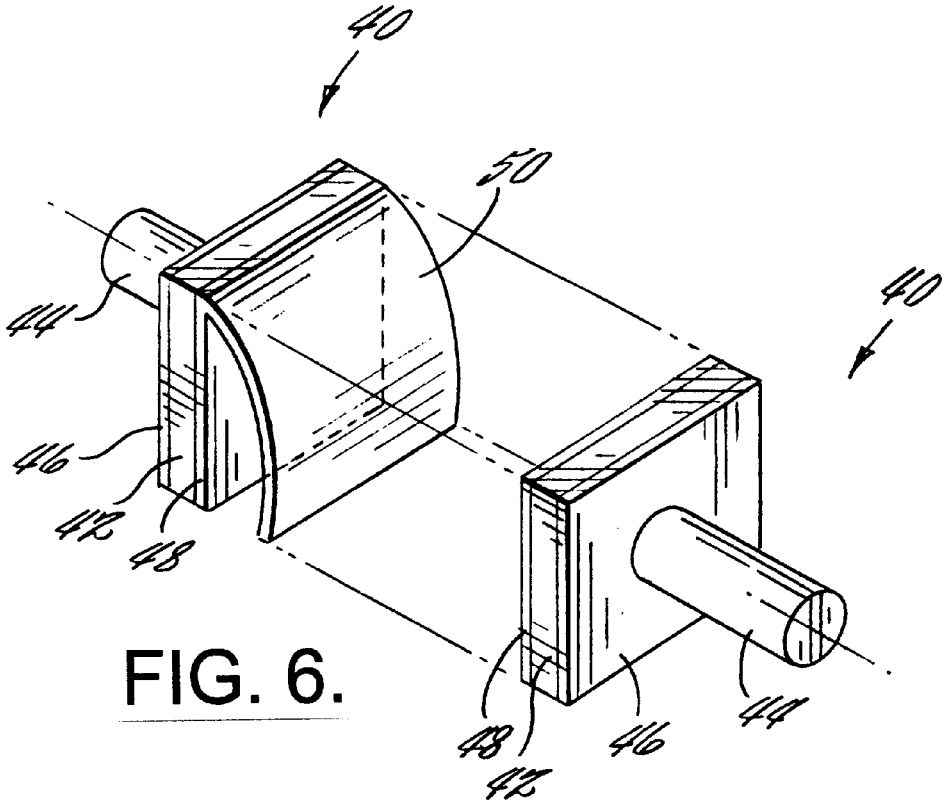
FIG. 6 is a perspective view of an electrical contact device having an extension arm extending outwardly from the outer surface of the contact pad to permit electrical contact to be established even if the respective contact pads do not mechanically abut.

As shown in FIG. 6, the electrical contact device 40 can include an outwardly extending extension arm 50 which permits the contact pad 42 to establish electrical contact with the contact pad of another electrical contact device in instances in which the edge surfaces 20 of the composite structures 10 do not completely abut. The extension arm extends outwardly from the outer surface 48 of the contact pad and is generally coated with the same highly conductive material as the outer surface of the electrical contact device, such as copper, nickel, gold or alloys, to further facilitate electrical contact with the contact pad of another electrical contact device.

Figures 5A, 5B, 5C, 5D:
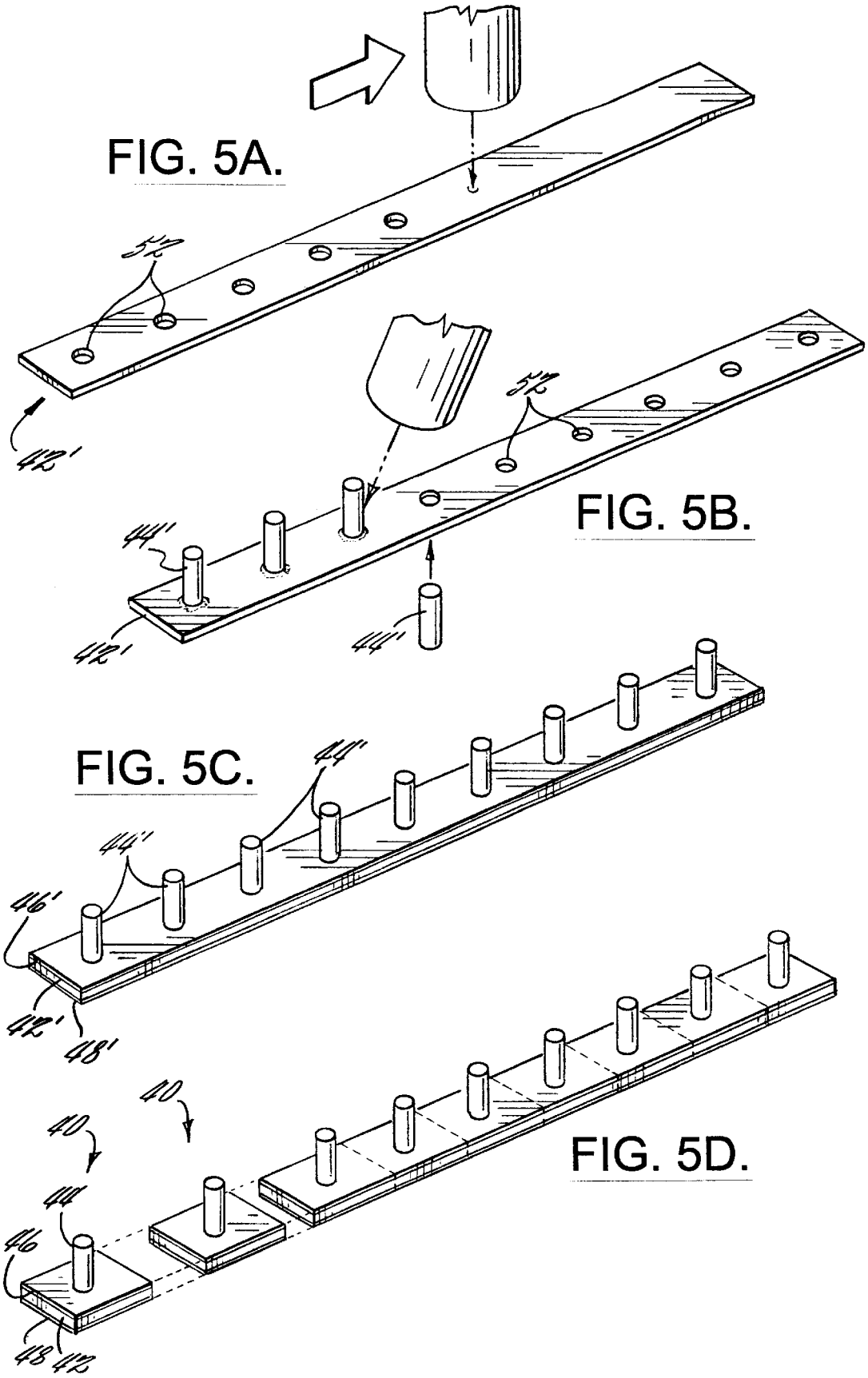
FIG. 5A is a perspective view of a strip of conductive material in which a number of holes are being formed.
FIG. 5B is a perspective view of pins being inserted into and bonded within holes formed in the strip of conductive material.
FIG. 5C is a perspective view of the conductive strip following the addition of a thin conductive layer of material to the outer surface of the strip and a thin insulative layer of material to the inner surface of the strip.
FIG. 5D is a perspective view illustrating the division of the conductive strip into a plurality of electrical contact devices.

Although the electrical contact devices 40 can be fabricated in a variety of manners, one particularly advantageous fabrication method is described hereinbelow. As shown in FIG. 5A, holes 52 are initially formed in a metal ribbon 42' at predetermined spaced intervals, such as by laser drilling. For example, the metal ribbon can be formed of stainless steel having a width of 0.167 inches and a thickness of 0.010 inches to 0.015 inches. According to this exemplary embodiment, holes having a diameter of 0.009 inches can be formed in the metal ribbon every 0.2 inches. Relatively short pieces of wire 44' can then be inserted into the holes from the backside as shown in FIG. 5B. The pieces of wire generally have the same diameter as the holes which have been formed in the metal ribbon, such as 0.009 inches in one embodiment. The pieces of wire are then laser welded to the ribbon as also illustrated in FIG. 5B.

According to one advantageous embodiment, the outer surface 48' of the ribbon 42' is then electroplated with a material having a greater conductivity than the metal ribbon. For example, the outer surface of the ribbon can be electroplated to form a layer of copper having a thickness of 0.0005 inches. See FIG. 5C. The inner surface 46' of the ribbon can then be coated with an insulating material, such as a thermoset epoxy that will also serve to bond the resulting electrical contact device 10 to an edge surface 20 of the composite structure 10 as described above. The ribbon is then divided or cut, typically with a laser, to form a number of electrical contact devices 40 as shown in FIG. 5D. While specific dimensions are provided above, it should be understood that the dimensions are for purposes of illustration since the electrical contact device and the various components of the electrical contact device can be varied without departing from the spirit and scope of the present invention.

Regardless of the method by which the electrical contact devices 40 of the present invention are fabricated, the electrical contact devices permit electrical contact to be readily established between corresponding electrical leads 16 embedded within a pair of composite structures 10. Once inserted into a respective port 28, the pin 44 makes electrical contact with one of the embedded electrical leads, while the remainder of the electrical contact device is electrically isolated from the edge surface 20 of the composite structure. By appropriately aligning the edge surfaces of a pair of composite structures, electrical and mechanical contact can be simultaneously established between one or more pairs of electrical contact devices, thereby making electrical contact between corresponding electrical leads embedded within the composite structures without requiring the electrical leads to extend outwardly from the composite structure and to be individually interconnected.

In the drawings and the specification, there has been set forth preferred embodiments of the invention, and, although specific terms are employed, the terms are used in a generic and descriptive sense only and not for the purpose of limitation, the scope of the invention being set forth in the following claims.

That which is claimed is:

1. A method for establishing electrical contact between electrical leads embedded within a pair of composite structures, wherein each composite structure includes at least one tubular member that is at least partially conductive and defines an electrical port, wherein the at least one tubular member is electrically connected at a first end to a respective electrical lead and has a second end opening through an edge surface of the composite structure, and wherein the method comprises the steps of:

electrically engaging the tubular member that defines the electrical port of each composite structure with a respective electrical contact device, wherein the electrical contact device comprises an electrical contact pad and a conductive pin connected to and extending outwardly from said electrical contact pad such that said electrically engaging step comprises inserting the conductive pin of the electrical contact device into the tubular member that defines the electrical port of the respective composite structure to thereby establish electrical contact between the tubular member that defines the electrical port and the electrical contact device, wherein the inserting comprises inserting the conductive pin to thereby form an electrical circuit comprising the electrical contact device, the tubular member that defines the electrical port and the respective electrical lead; and at least partially aligning corresponding electrical contact pads of each respective composite structure to thereby establish electrical contact between corresponding electrical leads embedded within the pair of composite structures.

2. A method according to claim 1 wherein each composite structure includes a plurality of tubular members that define respective electrical ports, wherein said electrically engaging step comprises inserting the conductive pin of the respective electrical contact device into each tubular member defining the respective electrical port.

3. A method according to claim 2 further comprising the step of simultaneously establishing electrical and mechanical contact between the plurality of electrical contact devices associated with one of the composite structures and corresponding ones of the plurality of electrical contact devices associated with the other composite structure.

* * * * *

UNITED STATES PATENT AND TRADEMARK OFFICE

CERTIFICATE OF CORRECTION

PATENT NO. : 6,438,829 B1
DATED : August 27, 2002
INVENTOR(S) : Haake

It is certified that error appears in the above-identified patent and that said Letters Patent is hereby corrected as shown below:

Column 10,
Line 61, insert the following:
-- providing a pair of composite structures, each of said composite structures having a tubular bore defining said electrical port, said tubular bore having a conductive surface thereon, said tubular bore having the first end electrically connected via an electrical lead to an electrical device and a second end opening through the edge surface of each of said composite structures --;
Line 57, "a", second occurrence, should read -- the --.

Signed and Sealed this

Tenth Day of December, 2002

JAMES E. ROGAN
*Director of the United States Patent and Trademark Office*